US011365589B2

(12) United States Patent
Cheng et al.

(10) Patent No.: US 11,365,589 B2
(45) Date of Patent: Jun. 21, 2022

(54) CUTTING ELEMENT WITH NON-PLANAR CUTTING EDGES

(71) Applicants: CNPC USA CORPORATION, Houston, TX (US); BEIJING HUAMEI INC., Beijing (CN)

(72) Inventors: Chris Cheng, Houston, TX (US); Jiaqing Yu, Houston, TX (US); Xu Wang, Beijing (CN); Xiongwen Yang, Beijing (CN); Yu Liu, Beijing (CN)

(73) Assignees: CNPC USA CORPORATION, Houston, TX (US); BEIJING HUAMEI, INC., Beijing (CN); CHINA NATIONAL PETROLEUM CORPORATION, Beijing (CN)

( * ) Notice: Subject to any disclaimer, the term of this patent is extended or adjusted under 35 U.S.C. 154(b) by 0 days.

(21) Appl. No.: 16/918,842

(22) Filed: Jul. 1, 2020

(65) Prior Publication Data

US 2021/0002962 A1 Jan. 7, 2021

Related U.S. Application Data

(60) Provisional application No. 62/870,166, filed on Jul. 3, 2019.

(51) Int. Cl.
*E21B 10/567* (2006.01)
*E21B 10/55* (2006.01)

(52) U.S. Cl.
CPC ..... *E21B 10/5673* (2013.01); *E21B 10/55* (2013.01)

(58) Field of Classification Search
CPC ..... E21B 10/5673; E21B 10/5671; E21B 10/5676
See application file for complete search history.

(56) References Cited

U.S. PATENT DOCUMENTS

| | | | | | |
|---|---|---|---|---|---|
| 5,351,772 | A * | 10/1994 | Smith | E21B 10/5735 | 175/428 |
| 5,890,552 | A * | 4/1999 | Scott | E21B 10/5735 | 175/426 |
| 6,065,554 | A * | 5/2000 | Taylor | E21B 10/5735 | 175/430 |
| 6,244,365 | B1 * | 6/2001 | Southland | E21B 10/5673 | 175/432 |
| 8,739,904 | B2 * | 6/2014 | Patel | E21B 10/52 | 175/428 |
| 10,753,157 | B2 * | 8/2020 | Rahmani | E21B 10/5676 | |
| 11,035,177 | B2 * | 6/2021 | Dubose | E21B 10/567 | |
| 2001/0004946 | A1 * | 6/2001 | Jensen | E21B 10/5673 | 175/428 |

(Continued)

*Primary Examiner* — Blake Michener
(74) *Attorney, Agent, or Firm* — Ramey LLP; William P. Ramey, III

(57) ABSTRACT

A cutting element comprising a cylindrical substrate; a table bonded to the cylindrical substrate; at least one tooth with a reduced projected cutting area on a periphery of the table; and a plurality of undulating cutting ridges on a top of the table. The table can have a working surface and at least one lateral surface, and a chamfer formed therebetween. The working surface can be a non-planar working surface. For a given weight on the bit, the cutter will sink into the rock deeper which can lead to better stability and more effective rock removal.

12 Claims, 8 Drawing Sheets

(56) References Cited

U.S. PATENT DOCUMENTS

2002/0071729 A1* 6/2002 Middlemiss ..... E21B 10/5735 407/114
2004/0163851 A1* 8/2004 McDonough ..... E21B 10/16 175/374
2006/0102389 A1* 5/2006 Wiseman ..... E21B 10/46 175/428
2006/0283639 A1* 12/2006 Yong ..... E21B 10/52 175/432
2007/0278017 A1* 12/2007 Shen ..... E21B 10/5673 175/426
2009/0057031 A1* 3/2009 Patel ..... E21B 10/5673 175/420.2
2010/0059287 A1* 3/2010 Durairajan ..... E21B 10/5673 175/420.2
2011/0266070 A1* 11/2011 Scott ..... E21B 10/5673 175/428
2012/0193152 A1* 8/2012 Russell ..... E21B 29/002 175/430
2015/0259988 A1* 9/2015 Chen ..... E21B 10/5673 175/430
2016/0032657 A1* 2/2016 Zhang ..... E21B 10/5673 175/430
2017/0058615 A1* 3/2017 Liang ..... E21B 10/5673
2018/0291689 A1* 10/2018 Palmer ..... E21B 10/55
2018/0291690 A1* 10/2018 Rahmani ..... E21B 10/42
2018/0334860 A1* 11/2018 Azar ..... E21B 10/5673
2019/0010763 A1* 1/2019 Crockett ..... E21C 35/183
2019/0063160 A1* 2/2019 Drews ..... E21B 10/5673
2019/0071932 A1* 3/2019 Bellin ..... B22F 7/064
2019/0106943 A1* 4/2019 Tilleman ..... E21B 10/5673
2019/0330928 A1* 10/2019 Graham ..... E21B 10/5676
2019/0390520 A1* 12/2019 Ramachandran ... E21B 10/5676
2020/0032588 A1* 1/2020 Izbinski ..... E21B 10/567
2020/0087758 A1* 3/2020 Zhao ..... B22F 7/06
2020/0157890 A1* 5/2020 Cuillier De Maindreville ..... E21B 10/55
2020/0347680 A1* 11/2020 Tian ..... E21B 10/5676

* cited by examiner

CUTTING ELEMENT WITH NON-PLANAR CUTTING EDGES

CROSS-REFERENCE TO RELATED APPLICATIONS

This application claims the benefit to U.S. provisional Application No. 62/870,166 filed on Jul. 3, 2019, the contents of which are incorporated by reference in its entirety.

FIELD

The disclosure relates generally to cutting elements and drill bits. The disclosure relates specifically to cutting elements in the field of drill bits used in petroleum exploration and drilling operation.

BACKGROUND

In drilling a borehole for the recovery of hydrocarbons or for other applications, it is conventional practice to connect a drill bit on the lower end of an assembly of drill pipe sections that are connected end-to-end so as to form a drill string. The bit is rotated by rotating the drill string at the surface and engaging the earthen formation, thereby causing the bit to cut through the formation material by either abrasion, fracturing, or shearing action to form a borehole along a predetermined path toward a target zone. Many different types of drill bits have been developed and found useful in drilling such boreholes.

The cutting elements disposed on the blades of a drill bit are typically formed of extremely hard materials. In a typical drill bit, each cutting element includes an elongate and generally cylindrical tungsten carbide substrate that is received and secured in a pocket formed in the surface of one of the blades. A conventional cutting element typically includes a hard-cutting layer of polycrystalline diamond ("PCD") or other super-abrasive materials such as thermally stable diamond or polycrystalline cubic boron nitride.

Cutting elements are desired that can better withstand high loading during drilling so as to have an enhanced operating life. Cutters that cut efficiently at designed speed and loading conditions and that regulate the amount of contact area in changing formations are also desired. In addition, cutting elements that have chip breaking feature are further desired.

SUMMARY

The present disclosure is directed to a cutting element that can penetrate into hard formation more easily and a concave surface feature that can break-up more plastic chips.

An embodiment of the disclosure is a cutting element comprising a cylindrical substrate; a table bonded to the cylindrical substrate; one or more teeth with a reduced projected cutting area on a periphery of the table; and a plurality of undulating cutting ridges on a top of the table.

In an embodiment, the cutting element further comprises at least two recessions formed into the periphery of the table, wherein the one or more teeth are formed in between the at least two recessions. In an embodiment, the at least two recessions are equally spaced around a circumference of the table and extend through a full depth of the table. In an embodiment, the one or more teeth are rounded, sharp, or serrated. In an embodiment, the number of one or more teeth is ten.

In some embodiments, the cutting element further comprises a working surface, at least one lateral surface, and a chamfer formed between the at least one lateral surface and the working surface. The at least two recessions are formed into an outer circumference of the table, wherein the at least two recessions begin at a working surface, extend perpendicular to the working surface, and slope gradually toward a lateral surface. In some embodiments, the depth of the at least two recessions range from 0.006" to ¼ of the diameter of the working surface and the length of the at least two recessions range from ½ to 2 times the thickness of the table. In an embodiment, an angle between the lateral surface and the chamfer is about 30-60 degrees. In an embodiment, the working surface is a non-planar working surface and the non-planar working surface includes a plurality of regional surfaces. A center of the non-planar working surface is higher than or equal to an edge of the non-planar working surface.

In some embodiments pertain to the working surface, a number of the plurality of regional surfaces is equal to that of the at least two recessions. The non-planar working surface includes a first ridge between two adjacent regional surfaces, the first ridge is a straight or curved line connecting the center of the non-planar working surface and a symmetric center of a tooth. In an embodiment, the regional surface is a planar structure or a curved structure. In an embodiment, the regional surface includes a second ridge, the second ridge is a straight or curved line connecting the center of the working surface and the symmetric center of an adjacent tooth. In an embodiment, the first ridge is higher than the second ridge such that the regional surface slopes gradually downwards from the first ridge to the second ridge.

In some preferred embodiments, an angle between the two adjacent regional surfaces intersecting at the first ridge is in a range from 100 to 179.5 degrees. An angle between the two adjacent regional surfaces intersecting at the second ridge is in a range from 180.5 to 260 degrees. A radius of the at least one tooth is in a range of 10%-100% of a radius of the cutting element.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3$^{rd}$ Edition.

Figure 1:
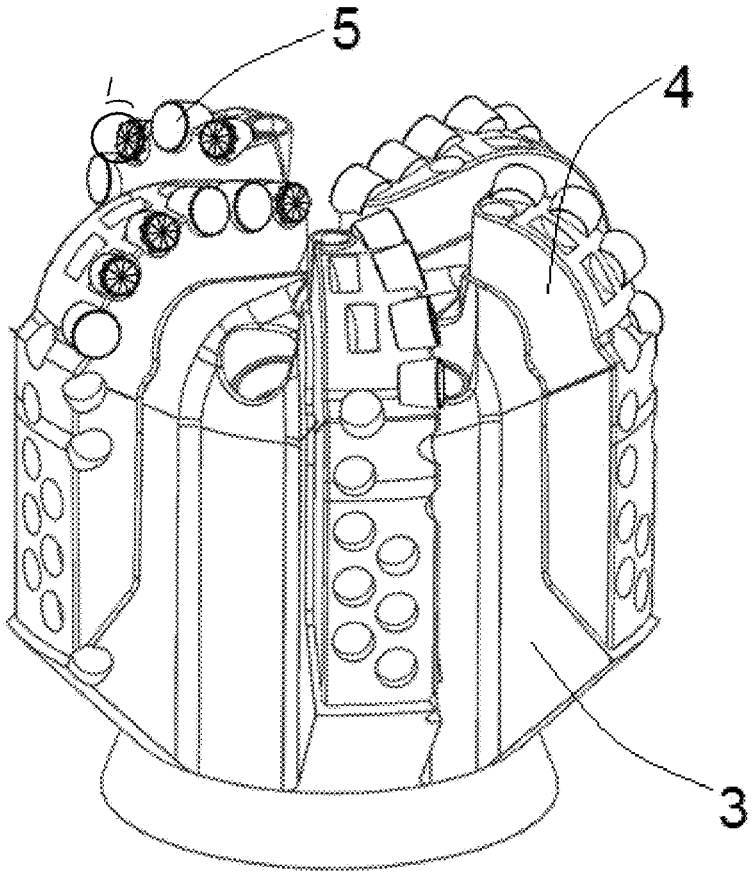
FIG. 1 is a perspective view of the arrangement of a drill bit.

Referring to FIG. 1, a drill bit comprises a drill bit body 3 and a plurality of blades 4, the blades project radially outward from the bit body 3 and form flow channels therebetween. Cutting elements 5 are grouped and mounted on the blades 4 in radially extending rows. The configuration or layout of the cutting elements 5 on the blades 4 may vary widely, depending on a variety of factors, such as the formation to be drilled.

Figure 2:
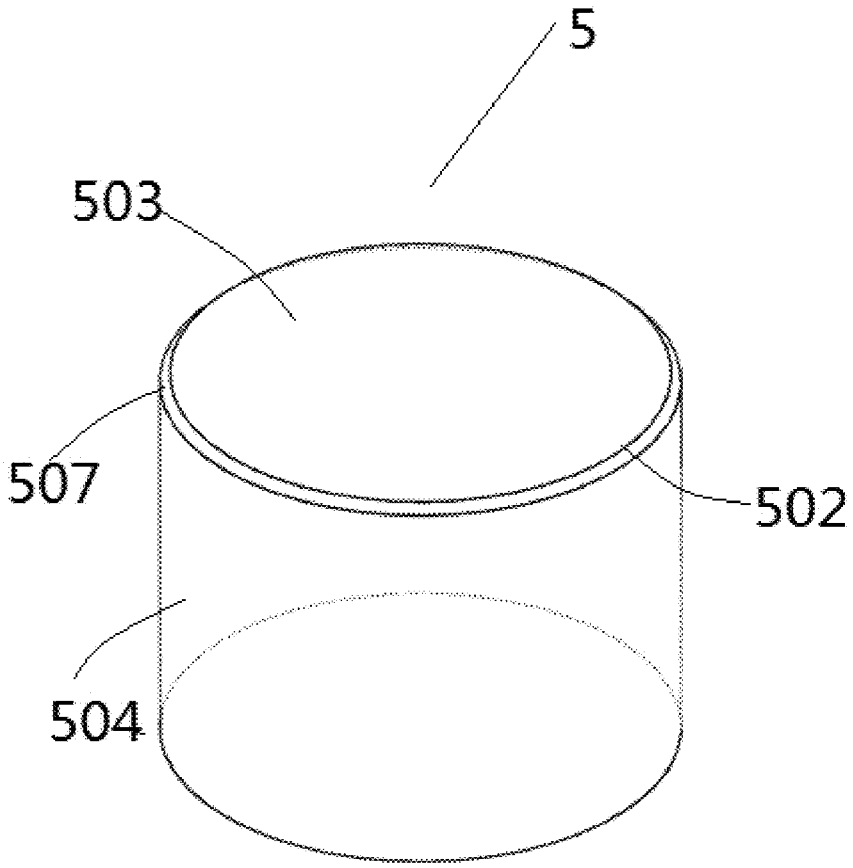
Fig. 2 (Prior Art)
FIG. 2 is a perspective view of the arrangement of a conventional cutting element.

Referring to FIG. 2, an example cutting element 5 includes a PCD table 502 and a cemented carbide substrate 504. The PCD table 502 includes an upper exterior working surface 503 and may include an optional chamfer 507 formed between the working surface 503 and the substrate 504. It is noted that at least a portion of the chamfer 507 may also function as a working surface that contacts a subterranean formation during drilling operations. Flat top cutting elements as shown in FIG. 2 are generally the most common and convenient to manufacture with an ultra-hard layer according to known techniques.

The working surface makes contact with the earth formations during drilling, it is subjected to the generation of peak (high magnitude) stresses form normal loading, shear force loading, and impact loading imposed on the table 502 during drilling. Because the cutting elements 5 are typically inserted into a drag bit at a rake angle, the peak stresses at the working surface alone or in combination with other factors, such as residual thermal stresses, can result in the initiation and growth of cracks across the table 502 of the cutting element 5. Cracks of sufficient length may cause the separation of a sufficiently large piece of ultra-hard material, rendering the cutting element 5 ineffective or resulting in the failure of the cutting element 5. When this happens, drilling operations may have to be ceased to allow for recovery of the drag bit and replacement of the ineffective or failed cutting element.

Figure 3:
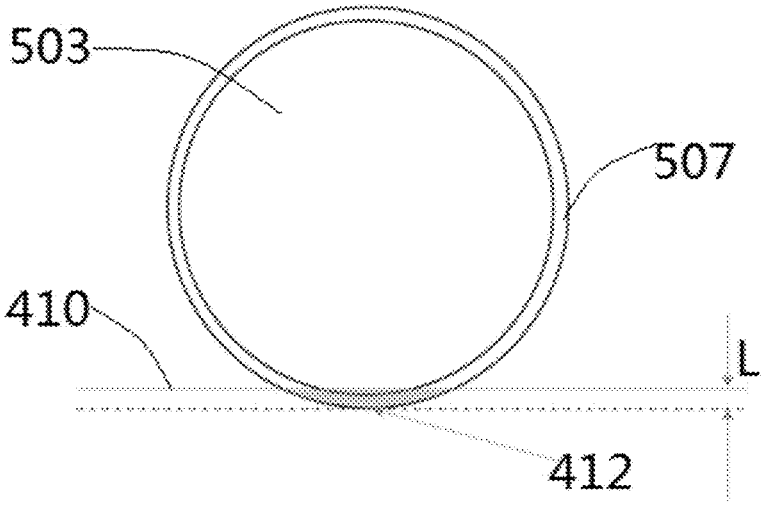
Fig. 3 (Prior Art)
FIG. 3 is an illustration showing a conventional cutting element cutting a rock.
Figure 4:
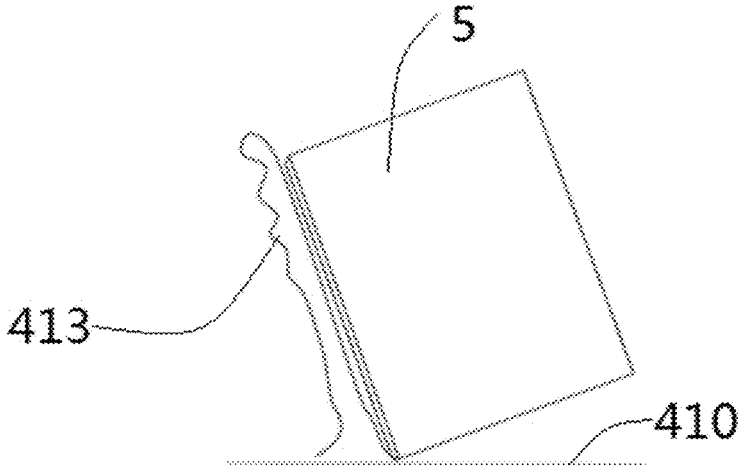
Fig. 4 (Prior Art)
FIG. 4 is an illustration showing debris cut by the cutting element of FIG. 3.

Referring to FIGS. 3 and 4, the conventional cutting element cuts the formation 410 with planar cutting edge, the contact area is 412 and the cut depth is L. In the drilling process, the PCD table 502 cuts rock and withstands great impact from the rock at the same time. Since the working surface of the PCD table 502 lacks the flexibility of reduced contact area, it is prone to impact damage when drilling into a high gravel content formation or a hard formation, resulting in damage to the cutting faces. On the other hand, when drilling in shale, mudstone and other formations, the debris produced by cutting through diamond composite sheet can easily form a long strip shape debris 413. Due to the large size of this kind of debris, it will easily attach to the blades 4 and body part of the bit to form balling, such that the cutting work faces of the blades of the bit are wrapped and unable to continue working, eventually leading to decrease of mechanical speed, no drill footage and other issues.

Figure 5:
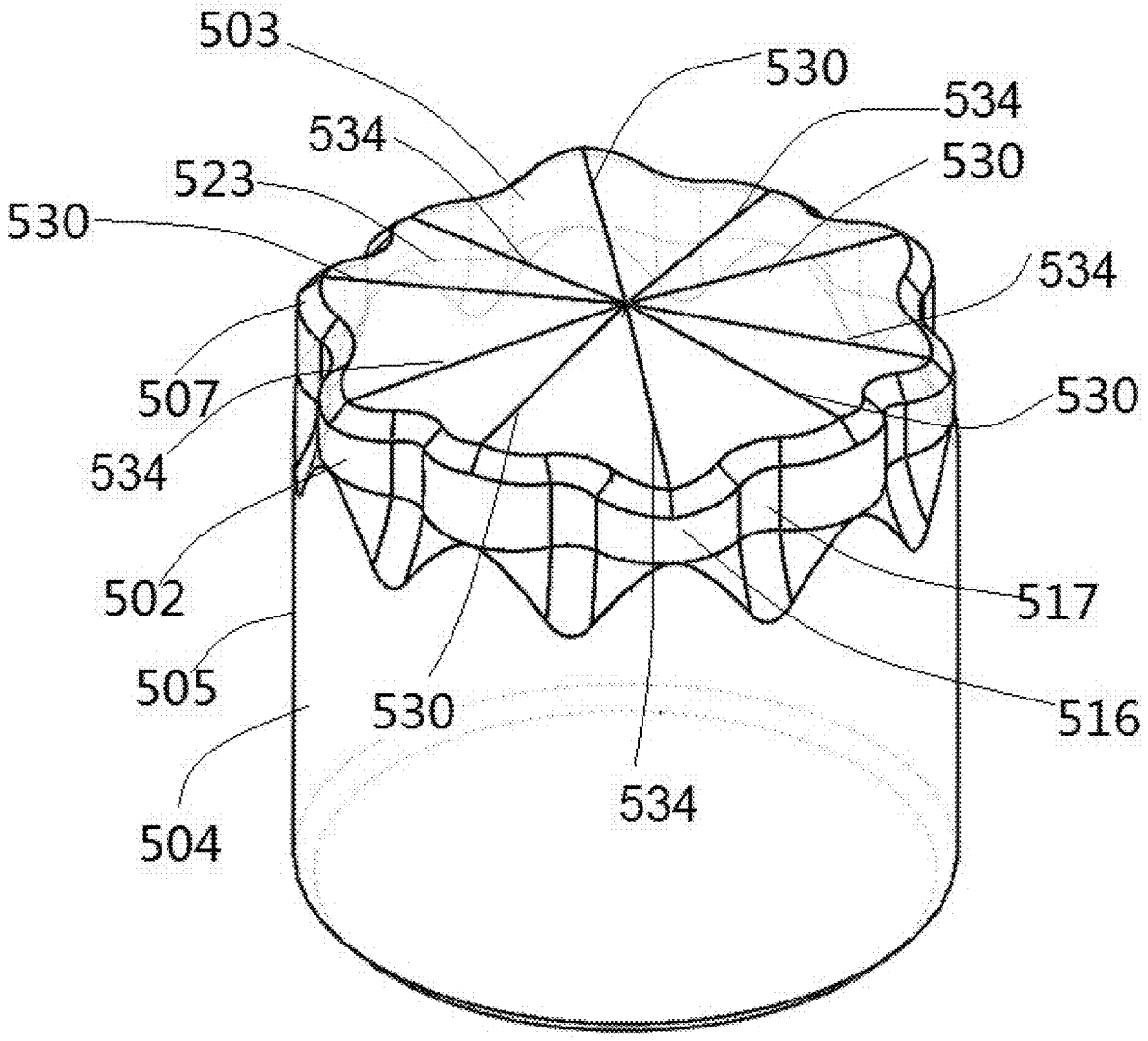
FIG. 5 is a perspective view of a cutting element in accordance with an embodiment disclosed herein.
Figure 6:
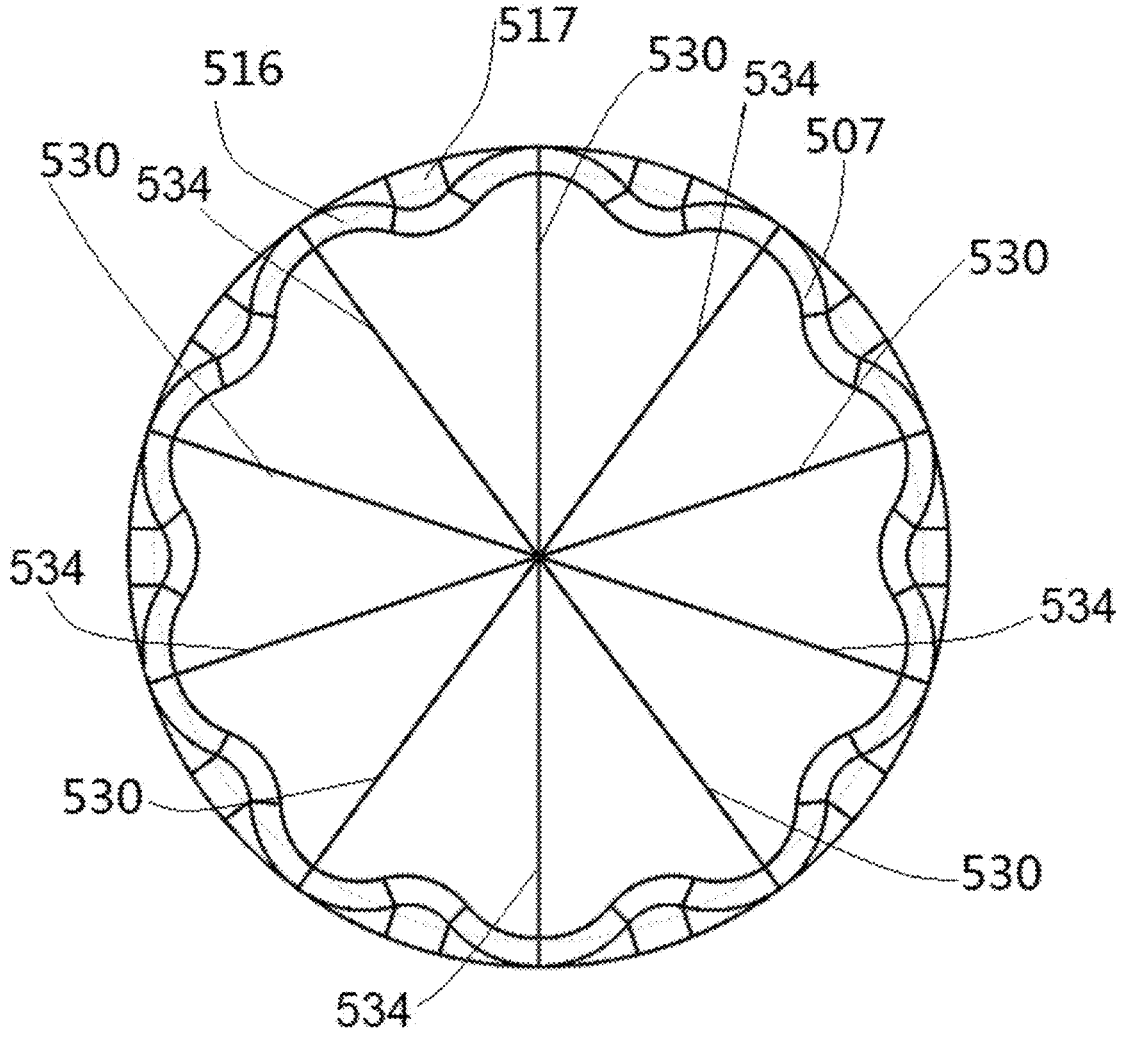
FIG. 6 is a top view of the cutting element of FIG. 5.
Figure 7:
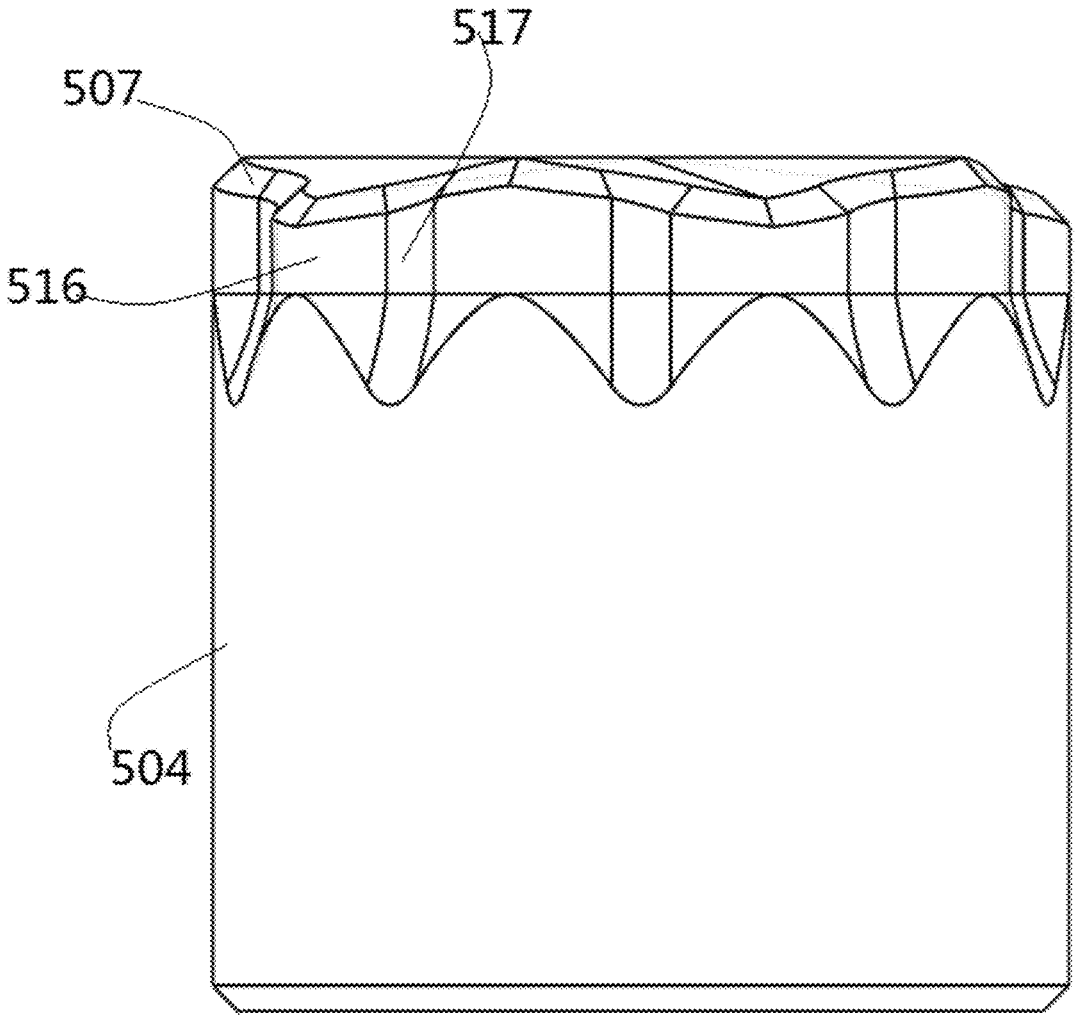
FIG. 7 is a front view of the cutting element of FIG. 5.

FIG. 5, FIG. 6, and FIG. 7 illustrate a cutting element 5 according to an embodiment of the disclosure. The cutting element 5 is substantially the form of a cylinder. It includes a table 502 bond to a substrate 504. The process for making a cutting element 5 may employ a body of cemented tungsten carbide as the substrate 504 where the tungsten carbide particles are cemented together with cobalt. The carbide body is placed adjacent to a layer of ultra-hard material particles such as diamond or cubic boron nitride particles and the combination is subjected to high temperature at a pressure where the ultra-hard material particles are thermodynamically stable. This results in recrystallization and formation of a polycrystalline ultra-hard material layer (the table 502), such as a polycrystalline diamond or polycrystalline cubic boron nitride layer, directly onto the upper surface of the cemented tungsten carbide substrate 504. The table 502 has a working surface 503 and at least one lateral surface 505, and a chamfer 507 formed therebetween. The angle between the side wall of the substrate 504 and the chamfer is about 45 degrees. At least a portion of the lateral surface 505 and/or the chamfer 507 may also function as a working surface.

In order to withstand the high loading during drilling and to have a chip breaking feature, the cutting element 5 is provided with multiple cutting points or edges. The cutting element 5 may be produced to incorporate two or more cutting edges into the outer circumference of the table 502. The two or more cutting edges may be formed into the outer circumference by any machining method, as known in the art. If at least one recession is machined into the table 502, two or more cutting edges may be formed into the outer circumference of the table 502. A tooth may thus be formed in between two recessions. The teeth may be flattened elongated triangular ridges that protrude from the outer circumference of the table 502. The teeth may also be rounded, sharp, serrated, or of some other desired shape. The recessions may be formed into the periphery or edge of a traditional cutting element. recessions may extend along the entire side of the cutting element, or the recessions may partially extend along the height of the cutting element, or the cutting element may extend fully or partially down the table of the cutter.

Referring to FIG. 5, axial recessions 517 are formed around the substantially side wall of the table 502, between each adjacent pair of recessions 517 a radial tooth 516 is defined. In one embodiment, the recessions 517 can be equally spaced around the circumference of the table 502 and extend through the full depth of the table 502 with no change in their geometry. In the arrangement illustrated there are ten recessions 517 in total, defining an equal number of teeth 516. Although reference is made herein to numbers and positions of recessions, it will be appreciated that the disclosure is not restricted to the specific arrangement described and illustrated and that a wide range of modifications and alterations may be made thereto without departing from the scope of the disclosure. For example, if more than one tooth 516 is present in such embodiments, the teeth 516 may be of different sizes and shapes. In one embodiment, the radius of teeth 516 can be from 10%-100% of the radius of the cutting element 5. The recessions 517 may be formed into the outer circumference of the table 502 at an inwardly sloping angle. The recessions 517 may be formed into the table 502 such they are non-parallel to the central axis of the cutting element 5, The angle of the recessions 517 may from about 15° to about 45° as relative to the central axis of the cutting element 5.

The cutting element 5 of the present disclosure further provides a non-planar exterior working surface 503. The working surface 503 includes a plurality of regional surfaces 523 and the center of the working surface 503 is higher or lower than the edge of the working surface 503. In one embodiment, the number of the regional surfaces 523 are equal to that of the recessions 517 or the teeth 516. In this scenario, the regional surfaces 523 include a first ridge 530 and a second ridge 534 and further, the first ridge 530 can be a straight line slopes up or down from the center apex to the periphery, connecting the center of the working surface 503 and the symmetric center of a tooth 516, such that each regional surface 523 has an approximate triangle shape. The first ridge 530 is higher than the second ridge 534 such that the regional surface slopes gradually downwards from the first ridge to the second ridge.

Figure 8:
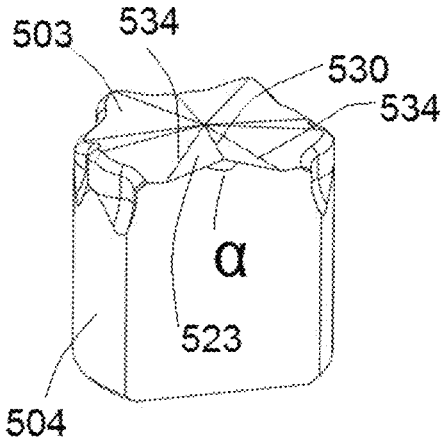
FIG. 8 is a sectional view of the cutting element of FIG. 5 showing an angle between two adjacent regional surfaces intersecting at the first ridge.
Figure 9:
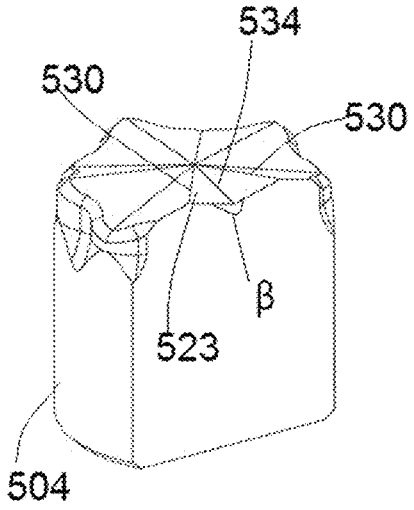
FIG. 9 is a sectional view of the cutting element of FIG. 5 showing an angle between two adjacent regional surfaces intersecting at the second ridge.

Referring to FIGS. 8 and 9, in an embodiment, the regional surfaces 523 can either be planar or curved. When the regional surfaces 523 is flat, the angle $\alpha$ between two regional flat surfaces 523 intersecting at the first ridge 530 can be from 100 to 179.5 degrees. In an embodiment, the second ridge 534 slopes down from the center apex to the periphery, the angle $\beta$ between the adjacent regional flat surfaces 523 intersecting at the second ridge 534 can be from 180.5 to 260 degrees.

In some embodiments, the first ridge 530 is a straight or curved line connecting the center of the non-planar working surface and a symmetric center of a tooth, the second ridge 534 is a straight or curved line connecting the center of the working surface and the symmetric center of an adjacent tooth. The first ridge is higher than the second ridge such that the regional surface slopes gradually downwards from the first ridge to the second ridge.

Figure 10:
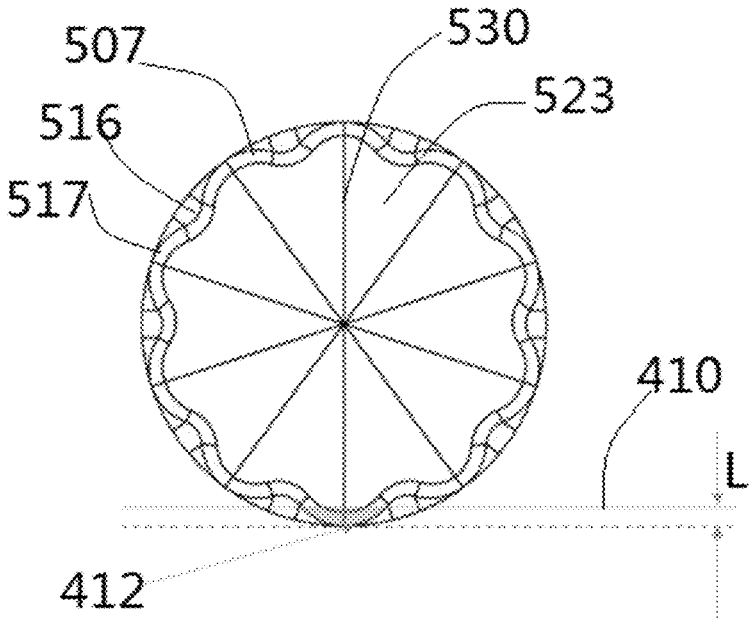
FIG. 10 is an illustration showing a cutting element of the present disclosure cutting a rock.
Figure 11:
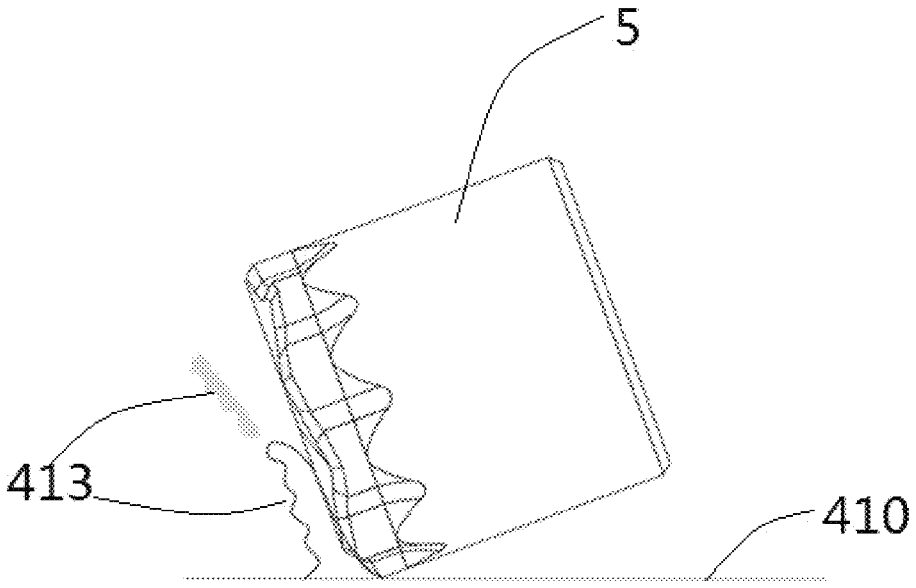
FIG. 11 is an illustration showing debris cut by the cutting element of FIG. 8.

During cutting with the cutting elements, one, two, or more of cutting points or edges may engage the material to be cut, such as rock. Referring to FIGS. 10 and 11, the cutting element 5 cuts the formation 410 with non-planar cutting edge, the contact area is 412 and the cut depth is L. The cutting element 5 of the present disclosure reduced the overall contact area at the cutting edge when cutting at the same depth of cut, reduced contact area leads to reduced friction and heat generated. For a given weight on bit, the cutter will sink into the rock deeper which can lead to better stability and more effective rock removal. The cutting area in FIG. 8 is reduced in comparison to that of the standard cutter in FIG. 3. This provides higher stress in the rock which results in improved cutting efficiency for hard formations.

In the drilling process, the teeth 516 and recessions 517 of the table 502 cut the rock alternately, the discontinuous cutting of the rock will produce debris 413 being shorter than debris produced by continuous cutting by conventional cutting elements. The ridges 530 separate the strip debris that are cut by cutting element 5 into smaller size debris. Provided are a concave and sloped top when comparing with standard feature break-up and direct the continuous chip away from the cutting surface which can further reduce the friction and heat generated.

Both first ridge 530 and second ridge 534 can be utilized for rock cutting, and the configurations depend on the rock properties and drilling conditions.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. A cutting element comprising a cylindrical substrate;

a table bonded to the cylindrical substrate;

at least two teeth with each having a reduced projected cutting area on a periphery of the table;

a non-planar working surface including a plurality of regional surfaces on the top of table;

at least two recessions formed into the periphery of the table, with each of the at least two teeth being formed in between two recessions of the at least two recessions;

wherein the working surface includes a plurality of first ridges each connecting a center of the working surface and a symmetric center of a periphery of each of the at least two teeth, a plurality of second ridges with each connecting the center of the working surface and a symmetric center of a periphery between two adjacent teeth of the at least two teeth, and wherein an angle between the two adjacent regional surfaces intersecting at one of the plurality second ridges is in a range from 180.5 to 260 degrees.

2. The cutting element of claim 1, wherein the at least two recessions are located around a circumference of the table and extend down along a depth of the table.

3. The cutting element of claim 1, wherein the at least one tooth is rounded, or sharp.

4. The cutting element of claim 1, wherein the number of the at least two teeth is in the range of 2-20.

5. The cutting element of claim 1, further comprising at least one lateral surface, and a chamfer formed between the at least one lateral surface and the working surface.

6. The cutting element of claim 5, wherein an angle between the lateral surface and the chamfer is 30-60 degrees.

7. The cutting element of claim 1, wherein a center of the non-planar working surface is higher than or equal to an edge of the non-planar working surface.

8. The cutting element of claim 1, wherein at least one of the first ridges from among the plurality of first ridges is a straight line connecting the center of the non-planar working surface and the symmetric center of a tooth.

9. The cutting element of claim 1, wherein each of the plurality of regional surfaces is a planar or a curved structure.

10. The cutting element of claim 9, wherein an angle between the two adjacent regional surfaces intersecting at the first ridge is in a range from 100 to 179.5 degrees.

11. The cutting element of claim 1, wherein at least one of the second ridges from among the plurality of second ridges is a straight line connecting the center of the non-planar working surface and the symmetric center of the periphery between two adjacent teeth of the at least two teeth.

12. The cutting element of claim 1, wherein a radius of the each of the at least two teeth is less than a radius of the cutting element.

* * * * *